US010573207B2

(12) United States Patent
Tuttle et al.

(10) Patent No.: US 10,573,207 B2
(45) **Date of Patent: *Feb. 25, 2020**

(54) SIGNAGE CLIP SYSTEM

(71) Applicant: Pratt Corrugated Holdings, Inc., Conyers, GA (US)

(72) Inventors: Jeffrey Alan Tuttle, Atlanta, GA (US); John Richard Muse, Douglasville, GA (US); Paul Ott, Atlanta, GA (US); Travis Walters, Atlanta, GA (US)

(73) Assignee: Pratt Corrugated Holdings, Inc., Conyers, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/447,628

(22) Filed: Jun. 20, 2019

(65) Prior Publication Data

US 2019/0304348 A1 Oct. 3, 2019

Related U.S. Application Data

(63) Continuation of application No. 15/864,403, filed on Jan. 8, 2018, now Pat. No. 10,388,197.

(51) Int. Cl.

| | |
|---|---|
| ***G09F 15/00*** | (2006.01) |
| ***G09F 7/18*** | (2006.01) |
| ***G09F 7/08*** | (2006.01) |

(52) U.S. Cl.

CPC ..... *G09F 15/0018* (2013.01); *G09F 7/08* (2013.01); *G09F 7/18* (2013.01);

(Continued)

(58) Field of Classification Search

CPC ..... G09F 15/0018; G09F 7/08; G09F 7/18; G09F 2007/1834; G09F 2007/1847; G09F 2007/1856

See application file for complete search history.

(56) References Cited

U.S. PATENT DOCUMENTS 2,530,821 A 11/1950 Hubbell
2,907,537 A * 10/1959 Mapson ..... G09F 7/18 248/477

(Continued)

FOREIGN PATENT DOCUMENTS

KR 200341956 9/2003

OTHER PUBLICATIONS

Tuttle, Jeffrey Alan; Applicant-Initiated Interview Summary for U.S. Appl. No. 16/263,843, filed Jan. 31, 2019, dated Aug. 23, 2019, 3 pgs.

(Continued)

*Primary Examiner* — Gary C Hoge
(74) *Attorney, Agent, or Firm* — Taylor English Duma LLP

(57) ABSTRACT

A display system includes: a first upright oriented vertically; a second upright oriented vertically and offset horizontally from the first upright by a frame separation distance, the first upright and the second upright defining a display opening therebetween; a first clip bracket secured to the first upright with a first clip fastener; and a second clip bracket secured to the second upright with a second clip fastener, each of the first clip bracket and the second clip bracket including a base portion and a clip portion, the base portion and the clip portion defining an insertion slot, a main entrance of the insertion slot of each of the first clip bracket and the second clip bracket facing forward, the clip portion configured to hold a display panel inside the insertion slot, the clip portion configured to hold an edge of the display panel against the base portion.

20 Claims, 9 Drawing Sheets

(52) U.S. Cl.
CPC ..... *G09F 2007/1834* (2013.01); *G09F 2007/1847* (2013.01); *G09F 2007/1856* (2013.01)

(56) References Cited

U.S. PATENT DOCUMENTS

| | | | | |
|---|---|---|---|---|
| 3,324,585 | A | 6/1967 | Frederickson | |
| 4,642,926 | A * | 2/1987 | Friedman | G09F 15/0068 40/605 |
| 5,624,044 | A * | 4/1997 | Black, Jr. | G09F 7/18 211/186 |
| 5,626,094 | A | 5/1997 | Jeffery et al. | |
| 5,924,367 | A * | 7/1999 | Henke | A47F 5/0087 108/108 |
| 6,026,603 | A | 2/2000 | Kump et al. | |
| 6,266,906 | B1 | 7/2001 | Nagel | |
| 6,430,857 | B1 | 8/2002 | Nagel | |
| 6,523,291 | B2 | 2/2003 | Nagel | |
| 6,601,809 | B1 | 8/2003 | Gebrara | |
| 6,665,969 | B1 * | 12/2003 | Conway | G09F 3/204 40/605 |
| 6,996,929 | B1 * | 2/2006 | Greene, Jr. | G09F 7/22 160/368.1 |
| 7,487,611 | B2 | 2/2009 | Robb | |
| D640,750 | S | 6/2011 | Bird et al. | |
| 8,099,891 | B2 | 1/2012 | Maier-Hunke | |
| D705,359 | S | 5/2014 | Kopco | |
| 9,038,300 | B2 | 5/2015 | Theisen et al. | |
| D748,730 | S | 2/2016 | Kopco | |
| D748,731 | S | 2/2016 | Kopco | |
| D748,732 | S | 2/2016 | Kopco | |
| 10,388,197 | B2 | 8/2019 | Tuttle et al. | |
| 2002/0029505 | A1 | 3/2002 | Faneuf | |
| 2003/0126722 | A1 | 7/2003 | Thompson | |
| 2004/0000078 | A1 * | 1/2004 | Jurgens | G09F 3/10 40/299.01 |
| 2004/0074126 | A1 * | 4/2004 | Gay | G09F 3/204 40/659 |
| 2004/0154202 | A1 * | 8/2004 | Gibson | G09F 7/22 40/617 |
| 2004/0195483 | A1 * | 10/2004 | Padiak | E05D 5/0215 248/289.11 |
| 2006/0117630 | A1 | 6/2006 | Raia et al. | |
| 2006/0254106 | A1 * | 11/2006 | Fast | G09F 3/204 40/661.03 |
| 2007/0094906 | A1 * | 5/2007 | Milligan | G09F 15/00 40/604 |
| 2008/0172917 | A1 * | 7/2008 | Brandow | G09F 15/00 40/606.14 |
| 2008/0282592 | A1 * | 11/2008 | Brinkman | G09F 3/204 40/661.03 |
| 2011/0214324 | A1 * | 9/2011 | White | B23P 19/00 40/611.06 |
| 2013/0061500 | A1 | 3/2013 | Bird et al. | |
| 2016/0046116 | A1 * | 2/2016 | Widener | G09F 3/12 156/249 |
| 2017/0004744 | A1 | 1/2017 | Carter | |
| 2017/0025045 | A1 * | 1/2017 | Helmholz | G09F 1/10 |
| 2017/0132957 | A1 * | 5/2017 | Logan | G09F 17/00 |
| 2017/0186346 | A1 * | 6/2017 | McNeal | G09F 15/0025 |
| 2017/0278435 | A1 * | 9/2017 | Shea | G09F 23/06 |
| 2018/0322815 | A1 * | 11/2018 | White | G09F 7/18 |
| 2019/0213928 | A1 | 7/2019 | Tuttle et al. | |
| 2019/0213929 | A1 | 7/2019 | Tuttle et al. | |

OTHER PUBLICATIONS

Tuttle, Jeffrey Alan; Non-Final Office Action for U.S. Appl. No. 16/263,843, filed Jan. 31, 2019, dated Oct. 15, 2019, 6 pgs.

Tuttle, Jeffrey Alan; Corrected Notice of Allowance for U.S. Appl. No. 15/864,403, filed Jan. 8, 2018, dated Jul. 18, 2019, 6 pgs.

Tuttle, Jeffrey Alan; Non-Final Office Action for U.S. Appl. No. 15/864,403, filed Jan. 8, 2018, dated Jan. 4, 2019, 15 pgs.

Tuttle, Jeffrey Alan; Notice of Allowance for U.S. Appl. No. 15/864,403, filed Jan. 8, 2018, dated Mar. 25, 2019, 5 pgs.

Tuttle, Jeffrey Alan; Supplemental Notice of Allowance for U.S. Appl. No. 15/864,403, filed Jan. 8, 2018, dated Jul. 11, 2019, 7 pgs.

Tuttle, Jeffrey Alan; Final Office Action for U.S. Appl. No. 16/263,843, filed Jan. 31, 2019, dated Jun. 27, 2019, 17 pgs.

Tuttle, Jeffrey Alan; Non-Final Office Action for U.S. Appl. No. 16/263,843, filed Jan. 31, 2019, dated Mar. 18, 2019, 9 pgs.

aliexpress.com; Article entitled: "J shape with tape soft pvc grip snap strip POP extrude clip KT board label holder shelf sign holder strip", located at . . . .

DGS Retail; Article for "Large Shelf Label Holders—Channel Strip Flips Up", located at <https://www.dgsretail.com/P7920/Large-Shelf-Label-Holders-Channel-Strips-for-Price-Tags-Flips-Up-4-x-48>, accessed on Jun. 5, 2017, 8 pgs.

emlexpress.com; Article entitled: "Shelf Pricing", located at <http://www.emlexpress.com/POS-Shelf-Fixtures-Management/shelf-pricing>, accessed on Jun. 5, 2017, 3 pgs.

POP Superstore; Article entitled: "Warehouse Power Wing Clip", located at <https://www.popsuperstore.com/Warehouse-Power-Wing-Clip-p/8305630200.htm>, accessed on Jun. 5, 2017, 2 pgs.).

Shop! Insights Center; Article entitled: "FFR Merchandising: Stand-off sign holder", located at < http://insights.retailenvironments.org/2014/04/30/ffr-merchandising-ztand-sign-holder/>, accessed on Jun. 5, 2017, 4 pgs.

Tuttle, Jeffrey Alan; Notice of Allowance for U.S. Appl. No. 16/263,843, filed Jan. 31, 2019, dated Nov. 25, 2019, 9 pgs.

* cited by examiner

SIGNAGE CLIP SYSTEM

REFERENCE TO RELATED APPLICATIONS

This application is a continuation of U.S. application Ser. No. 15/864,403, filed Jan. 8, 2018, which issued into U.S. Pat. No. 10,388,197 on Aug. 20, 2019, which is hereby specifically incorporated by reference herein in its entirety.

TECHNICAL FIELD

Field of Use

This disclosure relates to brackets for removably attaching a panel to a frame. More specifically, this disclosure relates to brackets for removably attaching a display panel to a rack inside a store.

Related Art

Display systems such as used inside a retail business often serve the dual purposes of storing product and advertising or otherwise drawing attention to the product. It can be beneficial to position a printed display panel—containing graphics describing the product and its features and benefits, for example—between uprights in a frame used to store and display the product. The size of the frame and the display panel and the distance between any fastening holes in the structural members can present challenges for mounting a display panel in a stable position. The same display panels that are typically used cannot be easily and securely attached to the frame without degrading the appearance of the display system and also requiring more time-consuming, and therefore costly, fasteners or attachment methods.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

In one aspect, disclosed is a display system comprising: a first upright oriented vertically; a second upright oriented vertically and offset horizontally from the first upright by a frame separation distance, the first upright and the second upright defining a display opening therebetween; a first clip bracket secured to the first upright with a first clip fastener; and a second clip bracket secured to the second upright with a second clip fastener, each of the first clip bracket and the second clip bracket comprising a base portion and a clip portion, the base portion and the clip portion defining an insertion slot, a main entrance of the insertion slot of each of the first clip bracket and the second clip bracket facing forward, the clip portion configured to hold a display panel inside the insertion slot, the clip portion configured to hold an edge of the display panel against the base portion.

In a further aspect, disclosed is a clip bracket comprising: a base portion defining a clearance hole configured to receive a fastener securing the base portion to a structure; and clip portion connected to the base portion, the base portion and the clip portion defining an insertion slot, a one of the base portion and the clip portion of the clip bracket comprising an engagement rib defining an effective width of the insertion slot that is less than a nominal width of the insertion slot.

In yet another aspect, disclosed is a method of assembling a display system comprising: securing a first clip bracket to a first upright of the display system with a first clip fastener, a longitudinal direction of an insertion slot of the first clip bracket and the first upright oriented vertically, the first clip bracket comprising a base portion and a clip portion, the base portion and the clip portion of the first clip bracket defining the insertion slot of the first clip bracket; securing a second clip bracket to a second upright of the display system with a second clip fastener, a longitudinal direction of an insertion slot of the second clip bracket and the second upright oriented vertically, the second clip bracket comprising a base portion and a clip portion, the base portion and the clip portion of the second clip bracket defining the insertion slot of the second clip bracket; and inserting a display panel horizontally into the insertion slot of the first clip bracket and the insertion slot of the second clip bracket.

Various implementations described in the present disclosure may comprise additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The accompanying drawings, which are incorporated in and constitute a part of this specification, illustrate several aspects of the disclosure and together with the description, serve to explain various principles of the disclosure. The drawings are not necessarily drawn to scale. Corresponding features and components throughout the figures may be designated by matching reference characters for the sake of consistency and clarity.

DETAILED DESCRIPTION

Figure 2:
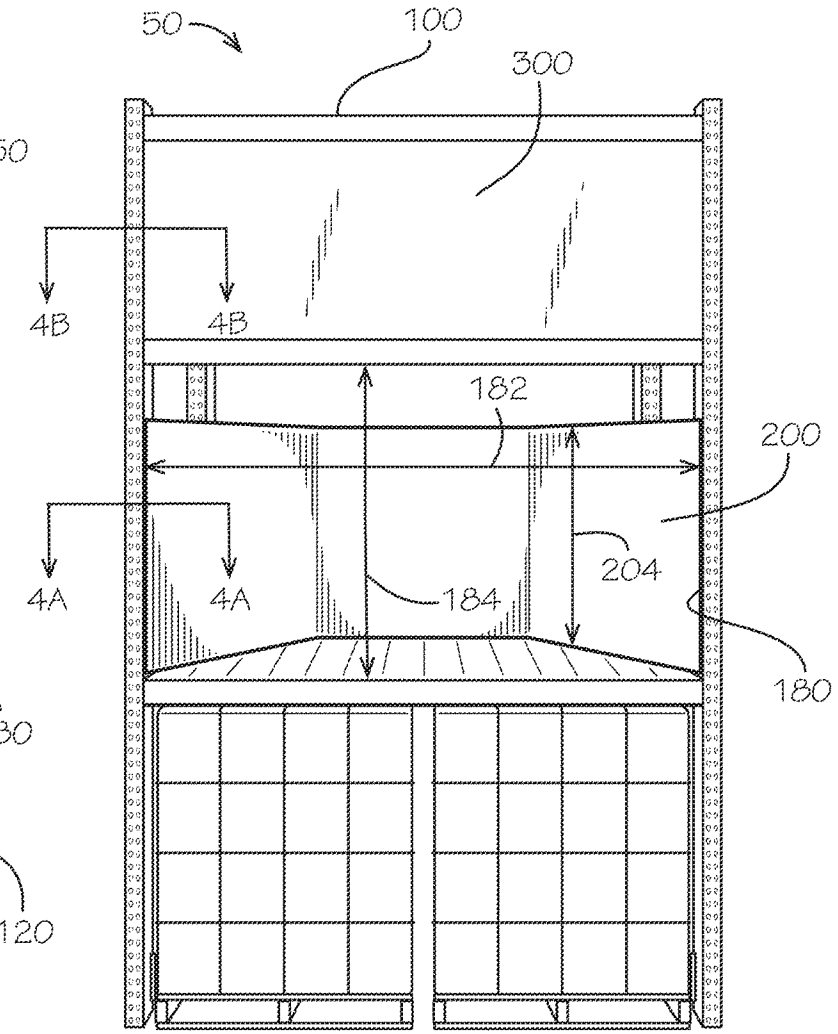
FIG. 2 is a front perspective view of the store display of FIG. 1 in accordance with another aspect of the current disclosure.

The present disclosure can be understood more readily by reference to the following detailed description, examples, drawings, and claims, and their previous and following description. However, before the present devices, systems, and/or methods are disclosed and described, it is to be understood that this disclosure is not limited to the specific devices, systems, and/or methods disclosed unless otherwise specified, as such can, of course, vary. It is also to be understood that the terminology used herein is for the purpose of describing particular aspects only and is not intended to be limiting.

The following description is provided as an enabling teaching of the present devices, systems, and/or methods in their best, currently known aspect. To this end, those skilled in the relevant art will recognize and appreciate that many changes can be made to the various aspects described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to a quantity of one of a particular element can comprise two or more such elements unless the context indicates otherwise.

Ranges can be expressed herein as from "about" one particular value, and/or to "about" another particular value. When such a range is expressed, another aspect comprises from the one particular value and/or to the other particular value. Similarly, when values are expressed as approximations, by use of the antecedent "about" or substantially," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance may or may not occur, and that the description comprises instances where said event or circumstance occurs and instances where it does not.

The word "or" as used herein means any one member of a particular list and also comprises any combination of members of that list.

To simplify the description of various elements disclosed herein, the conventions of "left," "right," "front," "rear," "top," "bottom," "upper," "lower," "inside," "outside," "inboard," "outboard," "horizontal," and/or "vertical" may be referenced. Unless stated otherwise, "front" describes that end or side of a store display in a store nearest to and occupied by a customer in the store; "rear" is that end of the store display that is opposite or distal from the front; "left" is that which is to the left of or facing left from the customer while the customer faces towards the front; and "right" is that which is to the right of or facing right from that same person in the same position. "Horizontal" or "horizontal orientation" describes that which is in a plane extending from left to right and aligned with the horizon. "Vertical," "oriented vertically," or "vertical orientation" describes that which is in a plane that is angled at 90 degrees to the horizontal.

In some aspects, a clip bracket and associated methods, systems, devices, and various apparatuses are disclosed herein. In some aspects, the clip bracket can define an insertion slot configured to receive a side end of a display panel. In other aspects, the clip bracket can be secured with a push-in clip fastener.

Figure 1:
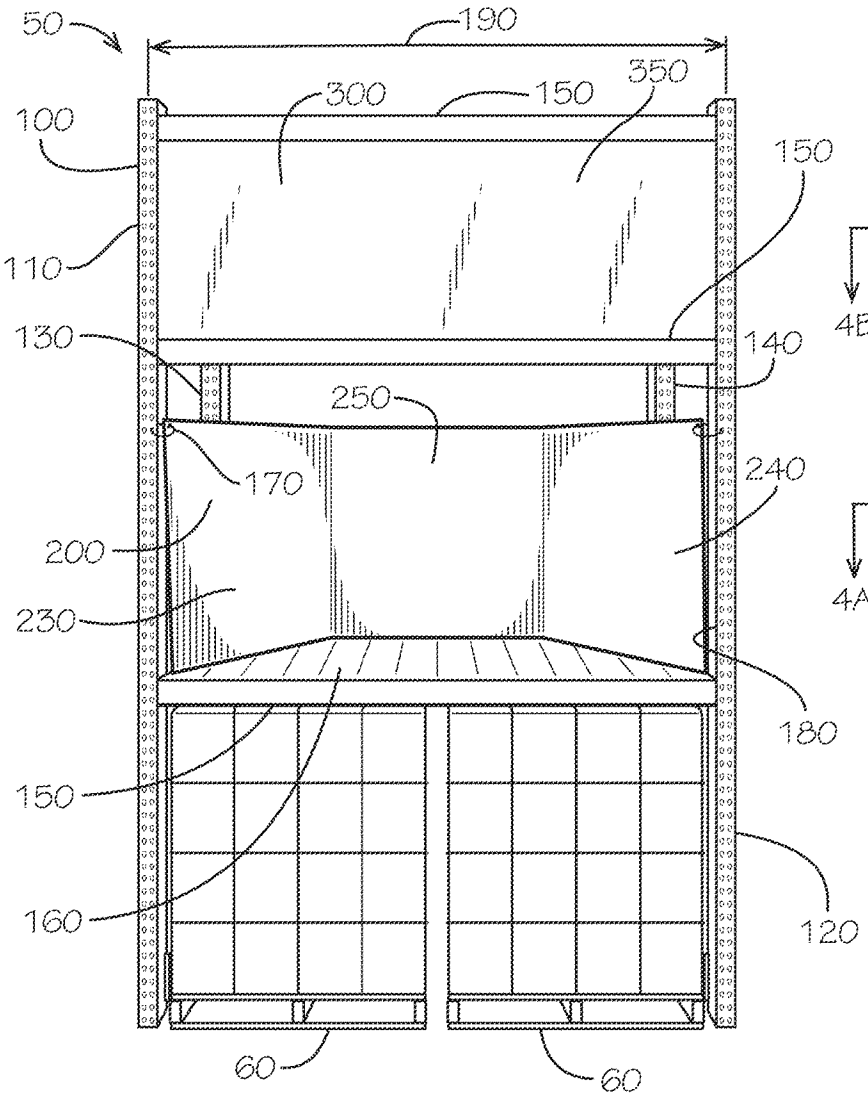
FIG. 1 is a front perspective view of a store display in accordance with one aspect of the current disclosure.

As shown in FIG. 1, a display system 50 can comprise a frame 100 comprising a first upright 110 and a second upright 120. The display system 50 can further comprise a third upright 130 and a fourth upright 140. As shown, each of the uprights 110,120,130,140 can be oriented vertically. Moreover, each of the uprights 110,120,130,140 can comprise a frame member, a vertical rail, a post, or a column. The first upright 110 and the second upright 120 can be considered front uprights, and the third upright 130 and the fourth upright 140 can be considered rear uprights. The second upright 120 can be offset horizontally from the first upright 110 by a frame separation distance 190. Likewise, the fourth upright 140 can be offset horizontally from the third upright 130 by the frame separation distance 190, although the offset or frame separation distance between the third upright 130 and the fourth upright 140 can be different than the offset or frame separation distance between the first upright 110 and the second upright 120 in other aspects. The first upright 110 and the second upright 120 can define a display opening 180 therebetween.

The frame 100 can further comprise a plurality of cross rails 150 and shelves 160, each of which can extend between a one of the uprights 110,120,130,140 to another of the uprights 110,120,130,140. A space between any two uprights 110,120,130,140, including on a floor beneath the frame 100 or on the shelves 160, can be used for storage of material such as, for example and without limitation, a palletized load 60, product (not shown) for display to users of the display system 50 (including, for example and without limitation, customers and employers of a business), a first display panel 200, or a second display panel 300.

The display panel 200 can comprise a center subpanel 250, and the display panel 300 can comprise a center subpanel 350. As shown, the display panel 200 can further comprise a first intermediate subpanel 230 and a second intermediate subpanel 240. The center subpanel 250 can extend from the first intermediate subpanel 230 to the second intermediate subpanel 240. Moreover, the center subpanel 250 can be connected to each of the first intermediate subpanel 230 and the second intermediate subpanel 240.

In some aspects, each of the display panels 200,300 can be secured to uprights such as, for example and without limitation, the first upright 110 and the second upright 120 using fasteners 170. Such fasteners can include, for example and without limitation, wire ties, tape (such as, for example and without limitation, double-sided foam tape), adhesive, or screws. To drive sales, it can be advantageous for the display panel 200,300 to not only be informative but to also be attractive. It can also be advantageous for the display panel 200,300 to be able to be precisely secured at any X, Y, or Z location relative to the frame 100 to maximize visibility and readability.

The display panel 200,300 itself can comprise any one of a number of materials receptive to printing processes or a printed film. Such materials can include, for example and without limitation, paper, plastic, or metal. Where a paper-based material is used, the display panel 200,300 can comprise a material such as, for example and without limitation a corrugated cardboard. Corrugated cardboard can combine the benefits of light weight, low cost, and strength. In other aspects, the display panel 200,300 can comprise a corrugated plastic material.

As shown, however, the use of wire ties as the fastener 170 can result in uneven and unsightly gaps and loose connections between the display panel 200 and each of the uprights 110,120. Furthermore, use of wire ties as the fastener 170 can mean that the display panel 200 must be supported by the shelf 160 and cannot be suspended above the shelf 160—or must be secured so tightly with the wire ties so as to cause deformation to the display panels 200,300. Using other fasteners can be accompanied by other problems. For example and without limitation, tape and adhesive can be time-consuming and messy to install and remove and can permanently damage the display panel 200 in the process. Screws and other mechanical fasteners can also be time-consuming to install, they can be visible and therefore can detract from the aesthetic appeal of the display panel 200 and thus render the installed display panel 200 unattractive, and their use can require adapters, spacers, or shims that are cumbersome and ineffective. In some aspects requiring removable fasteners 170, long bolts extending through holes 1090 (shown in FIG. 10A) defined in the uprights 110,120, 130,140 can be required to secure the display panel 200,300. This can be because the holes 1090 in the uprights 110,120, 130,140 of the frame 100 may not be designed for mounting of the display panels 200,300 shown but rather to mount other items or to facilitate attachment of the cross rails 150 and the shelves 160 to the uprights 110,120,130,140 at any one of dozens of vertical positions 1000 (shown in FIG. 10A). Nonetheless, the display system 50 can be adapted to fit even pre-existing features of the frame 100.

In some aspects, the frame 100 can define holes 1050 (shown in FIG. 10A), which can have a keyhole shape and, while used at times to loosely secure the fastener 170, can also be used to facilitate assembly of the frame 100. The holes 1050 can facilitate assembly by accepting an assembly fastener (not shown) connecting, for example and without limitation, the cross rail 150 to the upright 110. The assembly fastener can be installed through the larger end of the hole 1050 and lock in the smaller end of the hole 1050. In some aspects, the holes 1090 can have the shape of the holes 1050 and can function by receiving a clip fastener 800 (shown in FIG. 4A) as the holes 1090 receive the assembly fastener.

Figure 3:
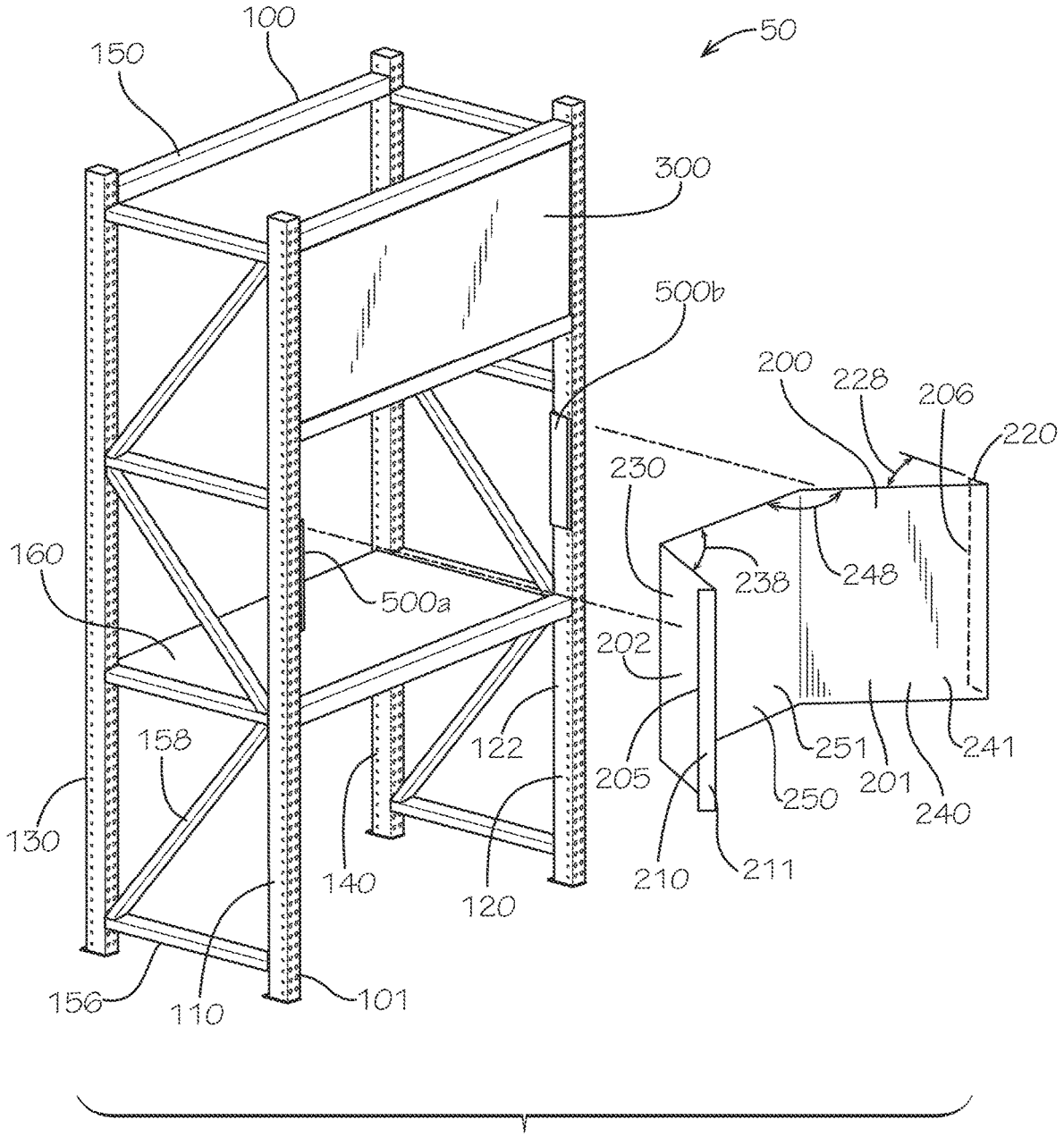
FIG. 3 is an exploded perspective view of the store display of FIG. 2 comprising a display panel and clip brackets.

As shown in FIG. 2, the display system 50 can comprise the display panel 200, which can be secured to the frame 100 with a first clip bracket 500*a* (shown in FIG. 3) and a second clip bracket 500*b* (also shown in FIG. 3). The display opening 180 can define a display opening width 182 and a display opening height 184. In some aspects, the first clip bracket 500*a*, the second clip bracket 500*b*, and the display panel 200 can together cover or extend at least partially across the display opening width 182 of the display opening 180 from the first clip bracket 500*a* to the second clip bracket 500*b*. In other aspects, the first clip bracket 500*a*, the second clip bracket 500*b*, and the display panel 200 can together cover or extend across the full display opening width 182 of the display opening 180 from the first clip bracket 500*a* to the second clip bracket 500*b*. In some aspects, as shown, a height 204 of the display panel 200 can extend only partially across the full display opening height 184. In other aspects, the height 204 of the display panel 200 can extend the full display opening height 184. In some aspects, the height 204 of the display panel 200 can be consistent across a width of the display panel 200. In other aspects, the height 204 of the display panel 200 can vary across the width of the display panel 200.

As shown in FIG. 3, the display panel 200 can comprise additional subpanels such as a first end subpanel 210 proximate to a first end 205 and a second end subpanel 220 proximate to a second end 206. Again, the display panel 200 can comprise the first intermediate subpanel 230, which can be connected to the first end subpanel 210. Likewise, the display panel 200 can comprise the second intermediate subpanel 240, which can be connected to the second end subpanel 220. Each of the subpanels 210,220,230,240,250 can be angled with respect to one another. For example and without limitation, each of the first intermediate subpanel 230 and the second intermediate subpanel 240 can be angled with respect to the center subpanel 250 by bend angles 238,248, respectively.

The frame 100, meanwhile, can comprise side rails 156 extending horizontally from or in a substantially horizontal orientation from the front uprights (e.g., the first upright 110 and the second upright 120) to the rear uprights (e.g., the third upright 130 and the fourth uprights 140). The frame can further comprise struts 158 extending from the front uprights (e.g., the first upright 110 and the second upright 120) to the rear uprights (e.g., the third upright 130 and the fourth uprights 140) at an angle to the side rails 156 or otherwise at an angle from the horizontal.

Each of the first upright 110 and the second upright 120 of the frame 100 can define a front surface 101 of the frame 100 and of the display system 50. The display panel 200 itself can define an outside surface 201 and an inside surface 202. In some aspects, at least a portion of the outside surface 201 of the display panel 200, which can comprise an outside surface 251 of the center subpanel 250 of the display panel 200, can be offset behind the front surface 101 (shown in FIGS. 4A and 4B). In other aspects, at least a portion of the outside surface 201 of the display panel 200 can be offset in front of the front surface 101.

The outside surface 201 of the display panel 200 can further comprise an outside surface 211 defined by the first end subpanel 210, an outside surface (not shown) defined by the second end subpanel 220, an outside surface 231 (shown in FIG. 4A) defined by the first intermediate subpanel 230, and an outside surface 241 defined by the second intermediate subpanel 240. The inside surface 202 can likewise comprise an inside surface 212 defined by the first end subpanel 210.

Each of the first upright 110 and the second upright 120 of the frame 100 can further define inward-facing surfaces 112,122, respectively (112 shown in FIG. 4A), each of which can also be considered side-facing surfaces. More specifically, the first clip bracket 500*a* can be secured to the inward-facing surface 112 of the first upright 110, and the second clip bracket 500*b* can be secured to the inward-facing surface 122 of the second upright 120.

The aforementioned structure can comprise the frame 100 or any other movable or immovable structure comprising an upright such as the uprights 110,120,130,140 able to support the clip brackets 500*a,b*. In some aspects, the structure can comprise, for example and without limitation, a single upright or a pair of uprights extending from the floor or from the ceiling or from the floor to the ceiling or from a horizontal structure such as the shelf 160 (including where only supported in a cantilever arrangement by a wall from which the shelf 160 can be made to extend). In some aspects, as will be described below, the uprights 110,120,130,140 can be oriented vertically. In other aspects, the uprights 110,120, 130,140 can be oriented at an angle with respect to the vertical direction and still accommodate the display system 50 disclosed herein. In some aspects, the longitudinal direction 503 of each of the clip brackets 500*a,b* can be oriented horizontally on a structure such as, for example and without limitation, the cross rails 150, and the clip brackets 500*a,b* can secure the display panel 200,300 when the display panel 200,300 extends from one of the cross rails 150 to another of the cross rails 150.

Figure 4A:
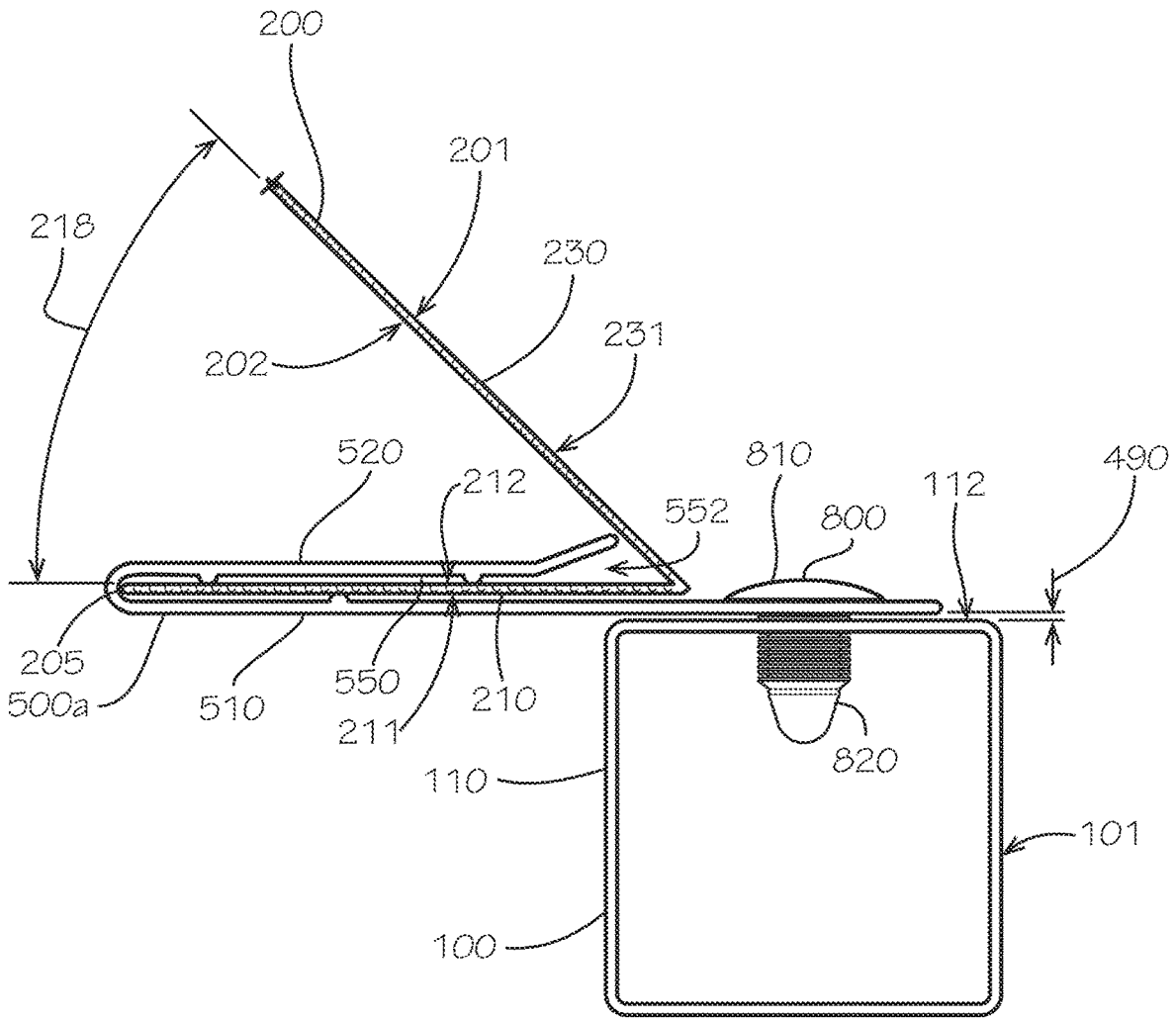
FIG. 4A is a top sectional view of the store display of FIG. 2 taken along line 4A-4A of FIG. 1.
Figure 4B:
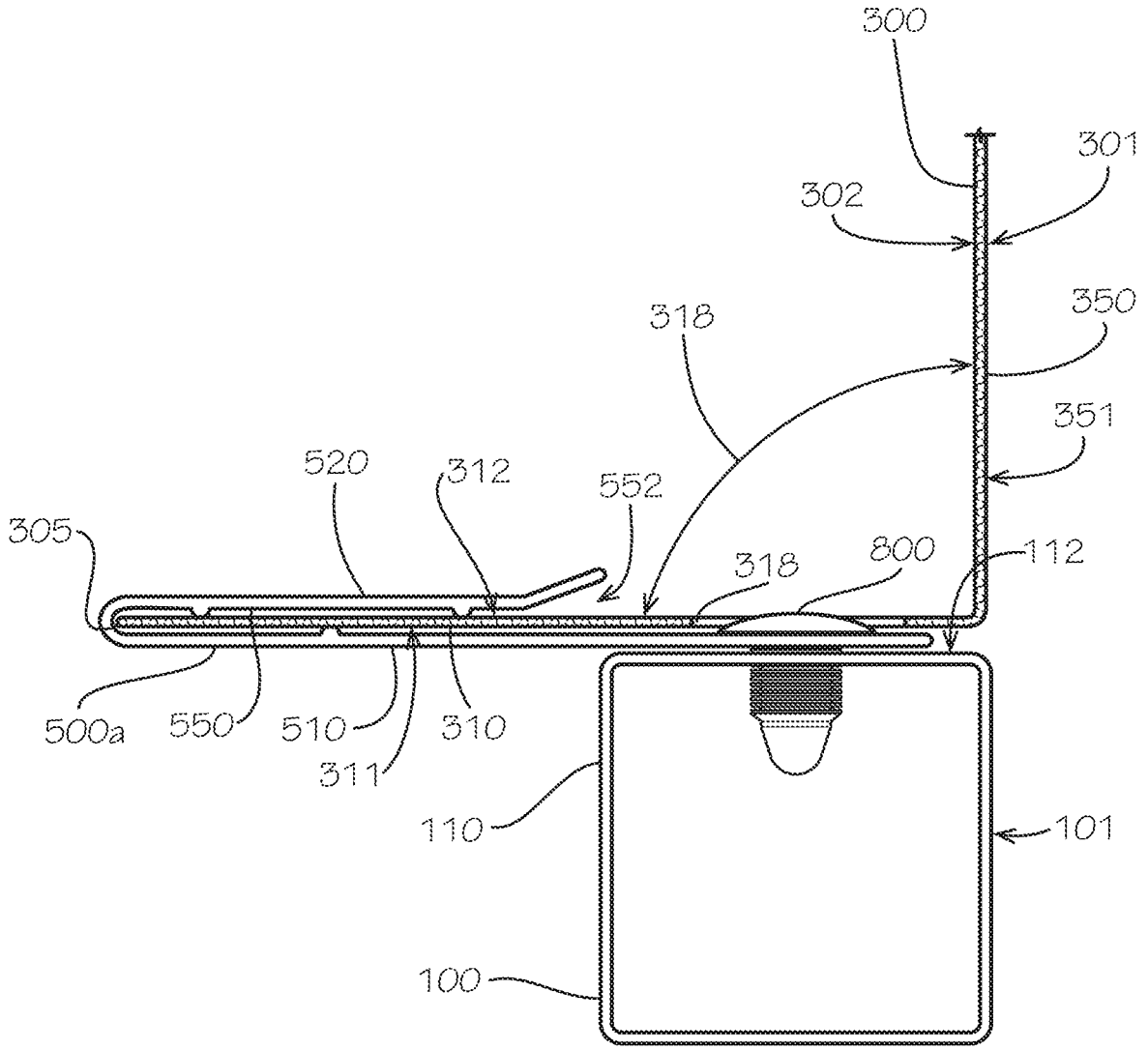
FIG. 4B is a top sectional view of the store display of FIG. 2 taken along line 4B-4B of FIG. 1

FIGS. 4A and 4B show sectional views of a connection between the display panels 200,300 and the frame 100. FIG. 4A specifically shows a sectional view of a connection between the display panel 200, the first clip bracket 500*a*, and the first upright 110, which is representative of (but a mirror image of) a connection between the display panel 200, the second clip bracket 500*b*, and the second upright 120. In some aspects, as shown in FIG. 4A, the first end subpanel 210 of the display panel 200 can be angled with respect to the first intermediate subpanel 230 by a bend angle 218. Likewise, the second end subpanel 220 of the display panel 200 can be angled with respect to the second intermediate subpanel 240 by a bend angle 228 (shown in FIG. 3). As shown, in some aspects, the bend angles 218,228 can each measure approximately 45 degrees. In other aspects, the bend angles can measure less than 45 degrees or more than 45 degrees, including as much as 90 degrees or more, and can be different from each other.

FIG. 4B specifically shows a sectional view of a connection between the display panel 300, the first clip bracket 500*a*, and the first upright 110, which is representative of (but a mirror image of) a connection between the display panel 300, the second clip bracket 500*b*, and the second upright 120. In some aspects, as shown in FIG. 4B, a first end subpanel 310 of the display panel 300 can be angled with respect to the center subpanel 350 by the bend angle 318. Likewise, a second end subpanel of the display panel 300 can be angled with respect to the center subpanel 350 by a bend angle (not shown), which can be equal to the bend angle 318 or can have a different value. As shown, in some aspects, the bend angle 318 and the bend angle between the second end subpanel and the center subpanel 350 can each measure approximately 90 degrees. In other aspects, the bend angles can measure less than 90 degrees or more than 90 degrees.

As shown in both FIGS. 4A and 4B, the first clip bracket 500*a* can be secured to the first upright 110 with the clip fastener 800. Likewise, the second clip bracket 500*b* can be secured to the second upright 120 with a second clip fastener 800. Each of the clip fasteners 800 can comprise a head 810 and a shank 820. In some aspects, as shown, a gap 490 can remain between the clip bracket 500*a,b* and the respective upright 110,120. In other aspects, the clip fasteners 800*a,b* can be pushed completely into the upright 110,120,130,140 so that the gap 490 disappears.

Each of the first clip bracket 500*a* and the second clip bracket 500*b* can comprise a base portion 510 and a clip portion 520. The base portion 510 and the clip portion 520 can together define an insertion slot 550. Either of the first clip bracket 500*a* and the second clip bracket 500*a* can be secured to the frame 100 such that a main entrance 552 (shown in FIG. 4B) of the insertion slot 550 of each of the first clip bracket 500*a* and the second clip bracket 500*a* can face forward. The clip portion 520 can be configured to hold the display panel 200 inside the insertion slot 550. For example and without limitation, the first end 205 of the display panel 200—and a corresponding structure of the display panel 300 including a first end 305 (shown in FIG. 4B)—can be secured inside the insertion slot 550 of the first clip bracket 500*a*, and the second end 206 (shown in FIG. 3) of the display panel 200—and a corresponding structure of the display panel 300 including a second end (not shown)—can be secured inside the insertion slot 550 of the second clip bracket 500*b*. More specifically, the clip portion 520 can be configured to hold the first end subpanel 210,310 or the second end subpanel 220 of the display panel 200,300 against the base portion 510.

As shown in FIG. 4A, the first end subpanel 210 of the display panel 200 can extend backwards into the insertion slot 550 of the first clip bracket 500*a* and the second end subpanel 220 can extend backwards into the insertion slot 550 of the second clip bracket 500*b*. Likewise, as shown in FIG. 4B, the first end subpanel 310 of the display panel 300 can extend backwards into the insertion slot 550 of the first clip bracket 500*a* and the second end subpanel can extend backwards into the insertion slot 550 of the second clip bracket 500*b*.

In some aspects, as shown in FIG. 4B, a portion of the display panel 300 such as, for example and without limitation, the first end subpanel 310, can define a relief hole 318. The relief hole 318 can reduce or eliminate interference between the first end subpanel 310 and the head 810 of the first fastener 800. In other aspects, including where the center subpanel is offset behind the front surface 101 of the frame 100 and even behind the position of the fastener 800*a,b*, no such relief hole need be present.

The display panel 300 can define an outside surface 301 and an inside surface 302. In some aspects, at least a portion of the outside surface 301 of the display panel 300, which can comprise an outside surface 351 of the center subpanel 350 of the display panel 300, can be even with or flush with the front surface 101 of the frame 100. In other aspects, at least a portion of the outside surface 301 of the display panel 300 can be offset behind or in front of the front surface 101. The outside surface 301 of the display panel 300 can comprise an outside surface 311 defined by the first end subpanel 310, and the inside surface 302 can likewise comprise an inside surface 312 defined by the first end subpanel 310.

Figure 5:
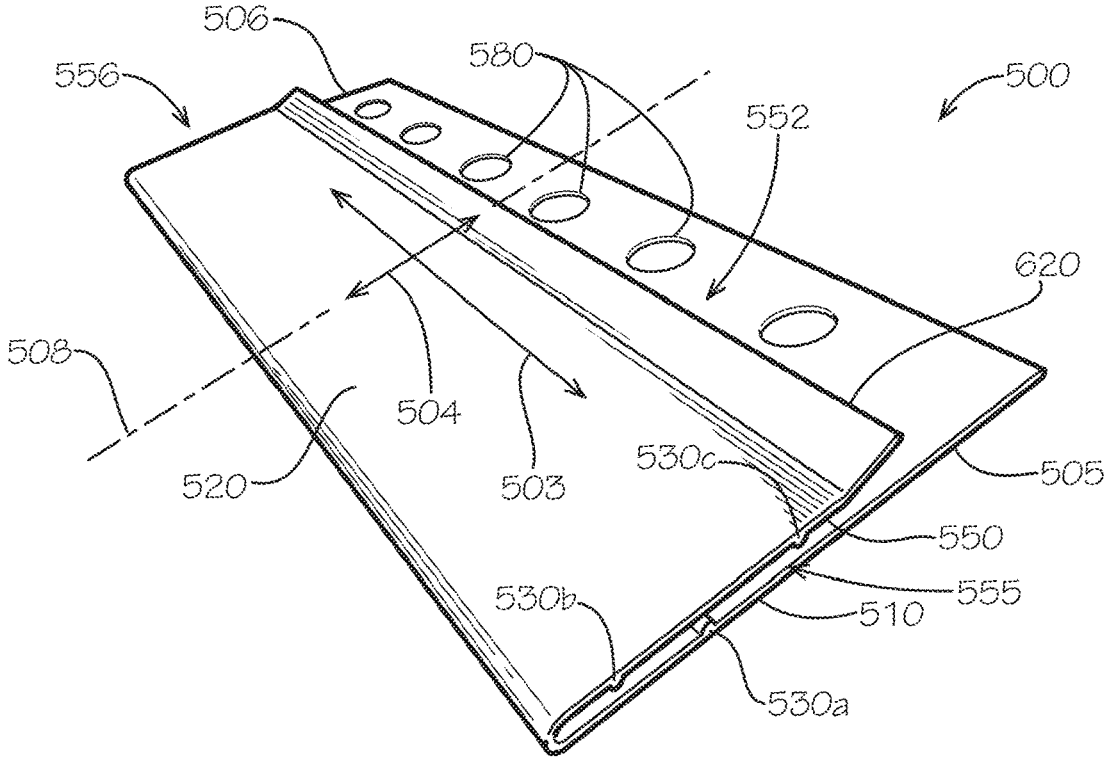
FIG. 5 is a perspective view of the clip bracket of FIG. 2.

FIG. 5 shows a clip bracket 500, which can be representative of both clip brackets 500*a,b*, which can be identical to each other in some aspects. As shown in FIG. 5, the clip bracket 500 can comprise the base portion 510 and the clip portion 520, which can be connected to the base portion. In one aspect, the clip portion 520 can be connected to the base portion 510 similarly to a first leg of a common hairpin being connected to a second leg of the hairpin. In some aspects, the clip bracket 500 can be symmetrical about a transverse centerline 508 parallel to a transverse direction 504 of the clip bracket 500*a,b*. When the bracket 500 is symmetrical about the transverse centerline 508, flipping the clip bracket 500*a* upside down about the transverse centerline 508 will result in the clip bracket 500*b*, and vice versa. In some aspects, the base portion 510 can define one or more clearance holes 580 configured to receive the fastener 800, which can secure the base portion 510 to a structure such as the frame 100.

In some aspects, each of the base portion 510 and the clip portion 520 of the clip bracket 500 can comprise an engagement rib 530*a,b,c*, described in further detail below, which can extend along a longitudinal direction 503 of the clip bracket 500*a,b*. In other aspects, the base portion 510 and the clip portion 520 can comprise any number of engagement ribs 530 in any desired position. In other aspects, no engagement rib 530*a,b,c* is present on either or both of the clip portion 520 or the base portion 510. As shown, a position of any of the engagement ribs 530*a,b,c* can be offset in the transverse direction 504 of the clip bracket 500 from each other. The insertion slot 550 of each of the clip brackets 500*a,b* can define side entrances 555,556 at longitudinal ends 505,506. In other aspects, the clip brackets 500*a,b* can comprise fewer than three or more than three engagement ribs 530*a*.

In some aspects, when a portion of the display panel 200,300 such as, for example and without limitation, one of the end subpanels 210,310,220 is inserted into the insertion slot 550 of the clip bracket 500, the engagement ribs 530*a,b,c*, can apply localized pressure to the portions of the display panel 200,300 that the engagement ribs 530*a,b,c* contact without requiring deformation of the entire surface of any portion of the display panel 200,300. Such localized pressure can be sufficient to hold the full weight of the display panel 200,300.

Figure 6:
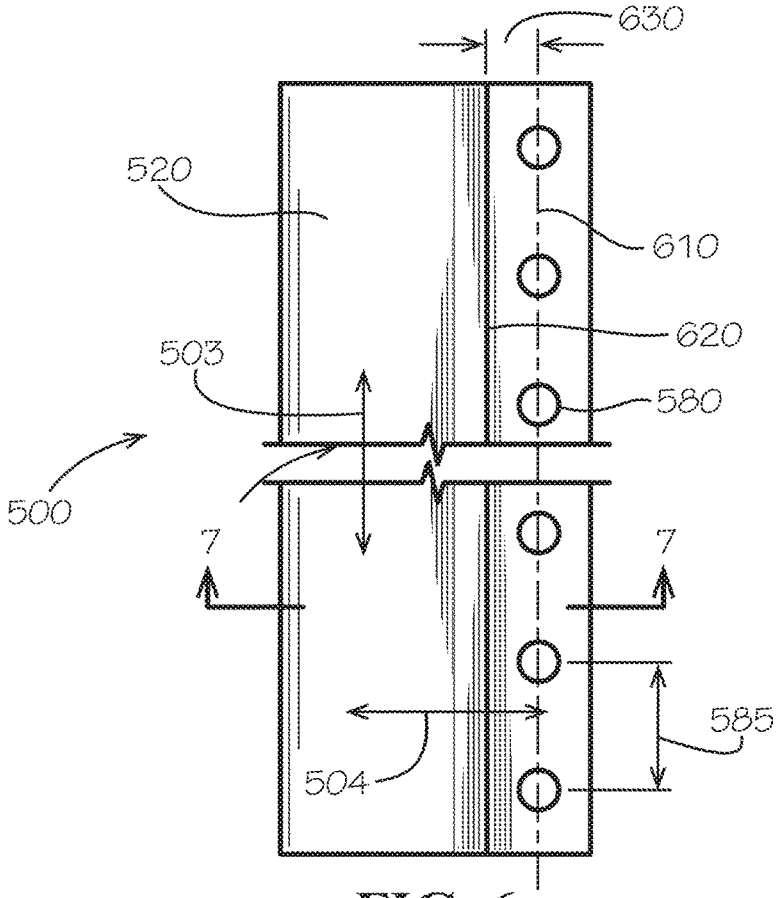
FIG. 6 is a side view of the clip bracket of FIG. 5.

As shown in FIG. 6, the plurality of clearance holes 580 can be aligned along a line 610, which can be parallel to the longitudinal direction 503 of the clip bracket 500. In some aspects, each of adjacent pairs of the plurality of clearance holes 580 can be spaced apart by a hole spacing 585 along the line 610. The hole spacing 585 can be made to match the spacing between adjacent vertical positions 1000 (shown in FIG. 10A) on the uprights 110,120,130,140 so that the clearance holes align with through holes 1090. In other aspects, the clearance holes 580 need not be aligned nor be spaced apart evenly by the hole spacing 585. In some aspects, a center of each of the plurality of clearance holes 580 can be offset from a forward edge 620 of the clip portion 520 of the clip bracket 500*a,b* by an offset distance 630.

Figure 7:
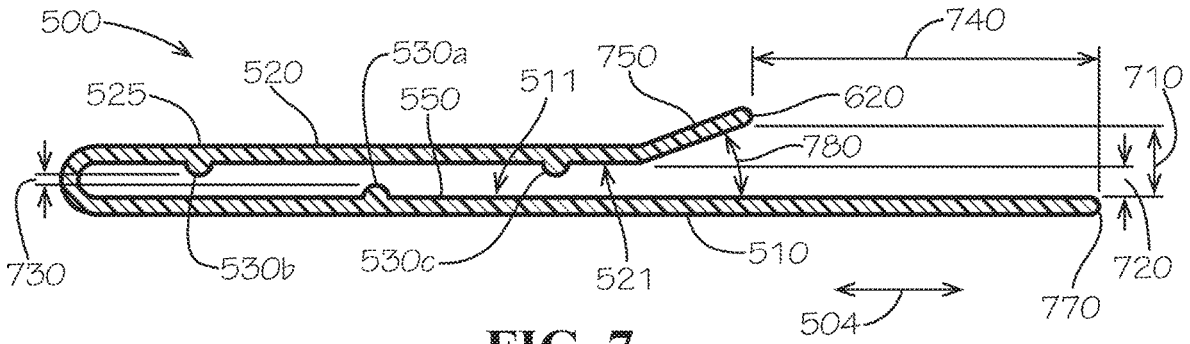
FIG. 7 is a sectional view of the clip bracket of FIG. 5 taken along line 7-7 of FIG. 6.

As shown in FIG. 7, the base portion 510 of the clip bracket 500 can be longer in the transverse direction 504 than the clip portion 520. More specifically, the forward edge 620 of the clip portion 520 can be offset from a forward edge 770 of the base portion 510 by an offset distance 740. A portion of the forward edge 620 of the clip portion 520 can be offset from a portion of the base portion 510 by a slot entrance height 710. The clip bracket 500 can define an insertion slot height 720 measured from an inside surface 511 of the base portion 510 to an inside surface 521 of the clip portion 520, where each of the inside surface 511 of the base portion 510 and the inside surface 521 of the clip portion 520 can define the insertion slot 550. The inward-facing surfaces defined by the engagement ribs 530*a,b,c* can define an effective slot height 730. The effective slot height 730 can be less than the insertion slot height 720, which can be a nominal width of the insertion slot 550, to facilitate retention of the display panel 200,300 inside the clip bracket 500. The effective slot height 730 can also be less than a thickness of the display panel 200,300 measured from the inside surface 201,301 of the display panel 200,300 to the outside surface 202,302 of the display panel 200,300, which can help ensure that each of the engagement ribs 530*a,b,c* applies pressure to the end subpanels 210,220,310 of the display panel 200,300 sufficient to secure the display panel 200,300 even when the display panel 200,300 is not otherwise supported.

The clip portion 520 can comprise an edge flange 750 defining the forward edge 620. In some aspects, the edge flange 750 can be angled with respect to a main portion 525 of the clip portion 520 and to the transverse direction 504, as well as with respect to the base portion 510, by a bend angle 780. In other aspects, the edge flange 750 can be parallel to a remaining portion of the clip portion 520 and to the base portion 510. In some aspects, the bend angle 780 of the edge flange 750 and the slot entrance height 710 being greater than the insertion slot height 720 can facilitate insertion of the display panel 200,300 inside the clip bracket 500.

Figure 8:
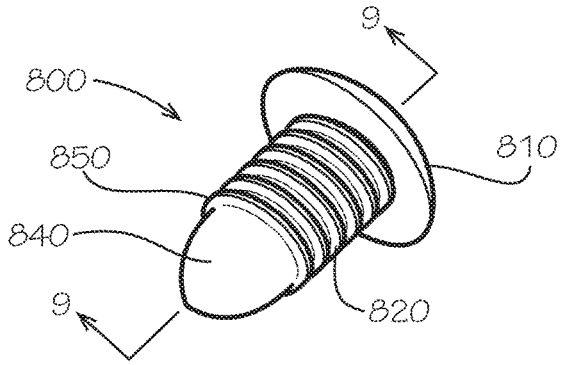
FIG. 8 is a perspective view of a clip fastener of the store display of FIG. 2.
Figure 9:
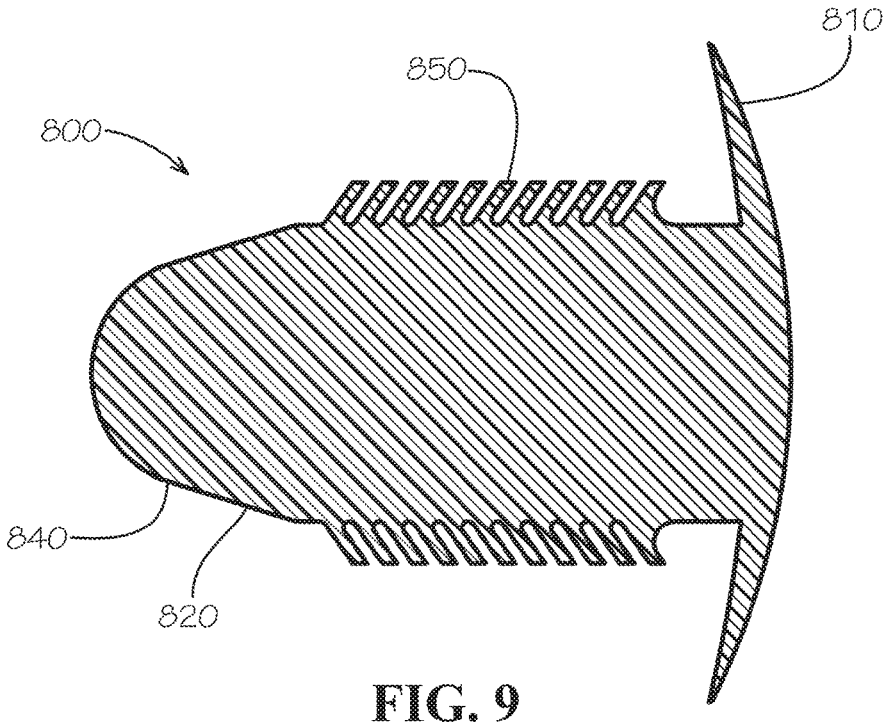
FIG. 9 is a sectional view of the clip fastener of FIG. 8 taken along line 9-9 of FIG. 8.

As shown in FIGS. 8 and 9, each of the clip fasteners 800 can comprise the head 810 and the shank 820. The head 810 can be rounded as shown to reduce interference between each of the clip fasteners 800 and the display panel 200,300 during insertion of the display panel 200,300 into the clip bracket 500. The head 810 can further be configured to lay substantially flat against the base portion 510, and the shank 820 can be sized to extend through the clearance hole 580 of the clip bracket 500 and through the hole 1090 of the frame 100. The shank 820 can comprise a tip 840, which can be tapered, rounded, or otherwise shaped to facilitate entry of the fastener 800 into the clearance hole 580 of the clip bracket 500 and through the hole 1090 of the upright 110,120,130,140 of the frame 100. The shank 820 of the clip fastener 800 can comprise a plurality of locking ribs 850, which can be configured to secure the clip fastener inside the hole 1090 defined in the upright 110,120,130,140 of the frame 100. The locking ribs 850 can be spaced close enough to accommodate a wide range of thicknesses of the material forming the uprights 110,120,130,140 (where a smaller spacing between the locking ribs 850 will generally accommodate a wider range of thicknesses). Each of the locking ribs 850 can be angled with respect to the shank 820 of the clip fastener 800 to facilitate installation and prevent unintentional removal, not unlike the barb on a fishhook is angled to facilitate one-way insertion into a material. The locking ribs 850 can individually designed to be sufficiently weak to bend during installation into a hole such as the hole 1090 but be withstand most loads without failure except those intended specifically to remove the fastener. The clip fastener 800 can be a push-in fastener. More specifically, the clip fastener 800 can be a "Christmas tree" fastener, a panel clip, a push-in rivet, or a canoe clip, each of which can be considered a push-in fastener.

Figure 10A:
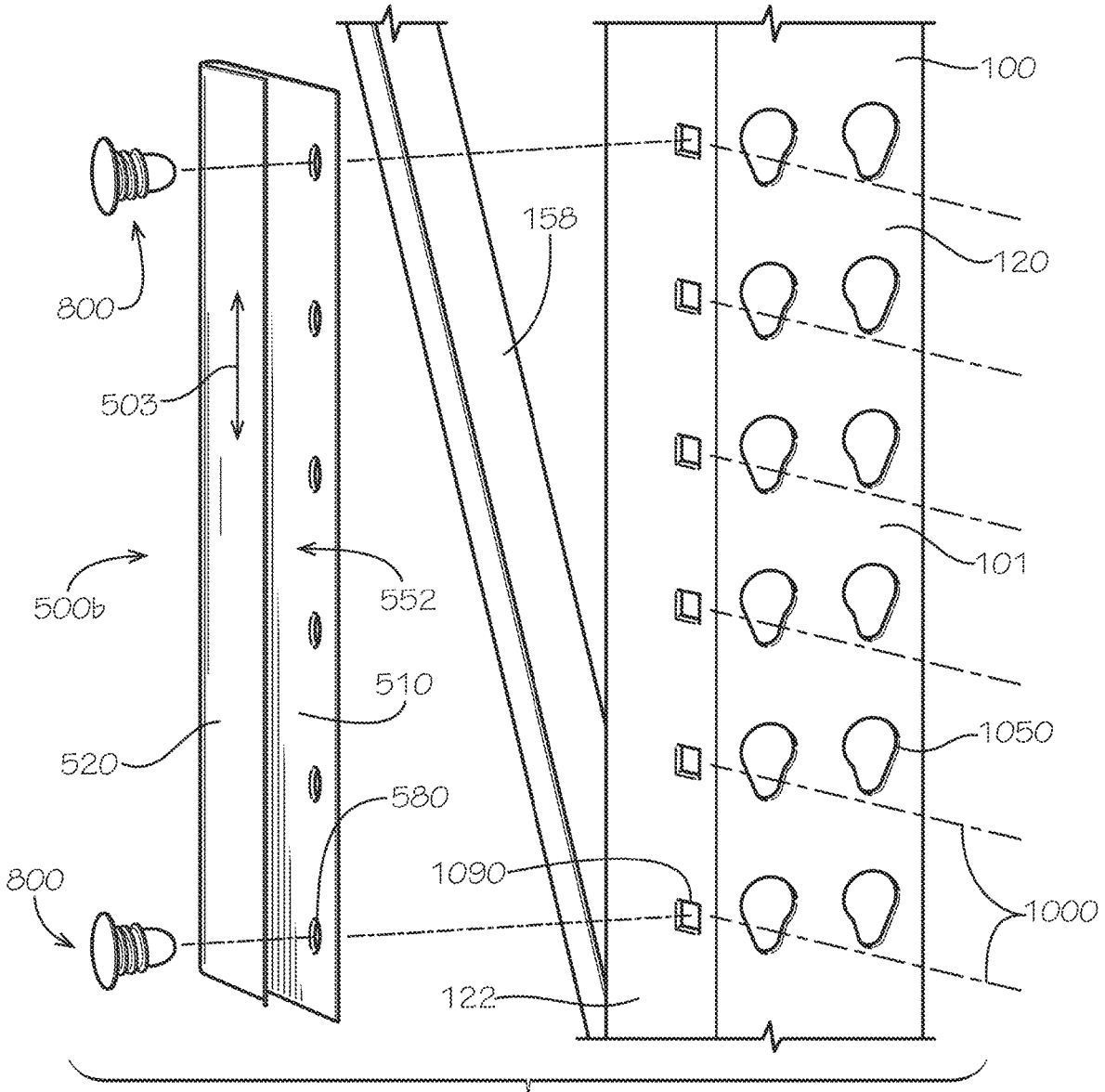
FIG. 10A is an exploded detail view of a portion of one side of the store display of FIG. 2 before assembly of the clip bracket of FIG. 5 and the clip fastener of FIG. 8 to a frame of the store display.
Figure 10C:
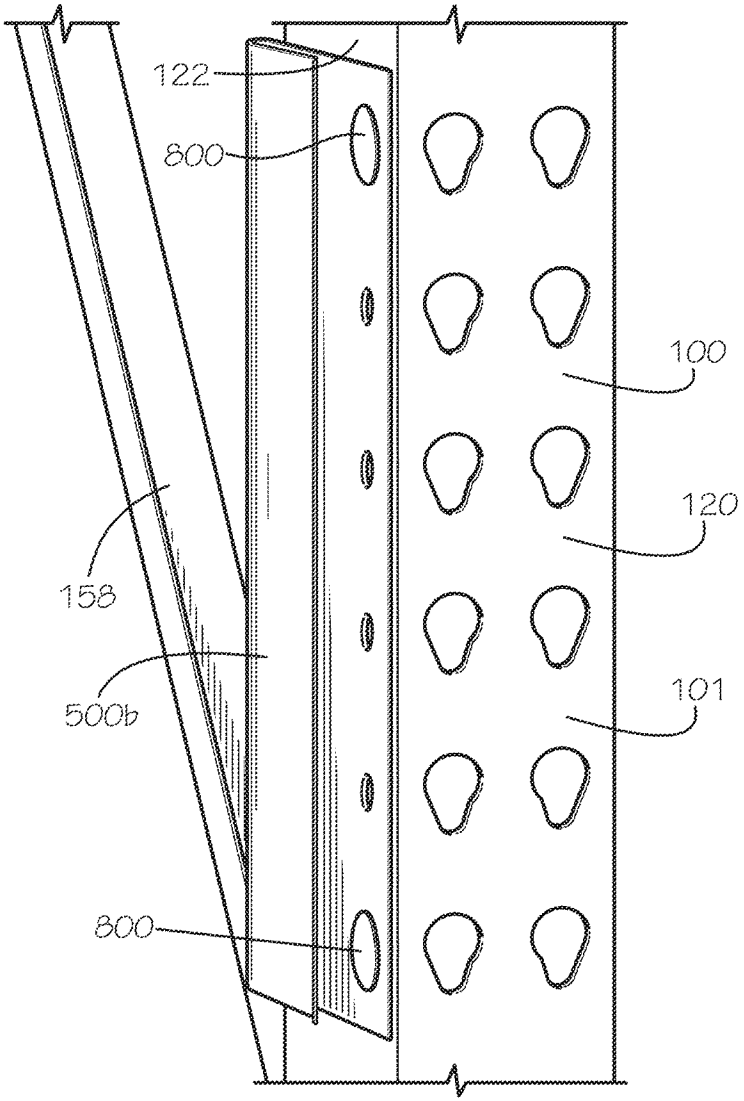
FIG. 10C is an exploded detail view of a portion of one side of the store display of FIG. 2 after assembly of the clip bracket of FIG. 5 and the clip fastener of FIG. 8 to the frame of the store display.
Figure 10B:
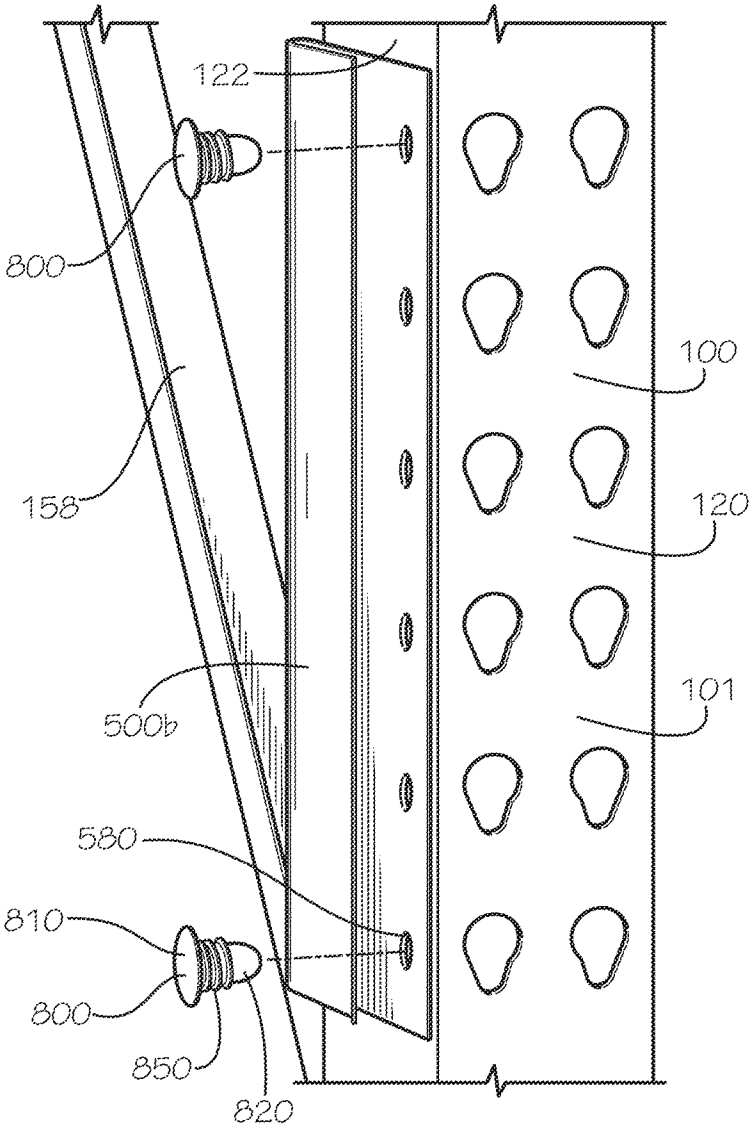
FIG. 10B is an exploded detail view of a portion of one side of the store display of FIG. 2 during assembly of the clip bracket of FIG. 5 and the clip fastener of FIG. 8 to the frame of the store display.

FIGS. 10A-10C show a method of assembling the display system 50. The method can comprise aligning the clearance holes 580 of the first clip bracket 500*a* (shown in FIG. 3) with the holes 1090 of the first upright 110 (shown in FIG. 3) of a structure such as, for example and without limitation, the frame 100 of the display system 50. As shown in FIG. 10A, the method can further comprise similarly aligning clearance holes 580 of the second clip bracket 500*b* with the holes 1090 of the second upright 120 of the frame 100.

The method can further comprise securing the first clip bracket 500*a* to the first upright 110 of the display system 50 with the clip fastener 800. The longitudinal direction 503 of the insertion slot 550 of the first clip bracket 500*a* and the first upright 110 can be oriented vertically. As shown, the method can further comprise similarly securing the second clip bracket 500*b* to the second upright 120 of the display system 50 with the clip fastener 800, and the longitudinal direction 503 of the insertion slot 550 of the second clip bracket 500*b* and the second upright 120 can be oriented vertically. Securing the first clip bracket 500*a* can comprise inserting the shank 820 of the first clip fastener 800 through the base portion 510 of the first clip bracket 500*a* and into the first upright 110 by pushing the head 810 of first clip fastener 800. Securing the second clip bracket 500*b* can comprise inserting the shank 820 of the clip fastener 800 through the base portion 510 of the second clip bracket 500*b* and into the second upright 120 by pushing the head 810 of the clip fastener 800.

In some aspects, two clip fasteners 800 can be used to secure each clip bracket 500*a,b*. In other aspects, more than two clip fasteners 800 or only one clip fastener 800 can be used to secure each clip bracket 500*a,b*. In other aspects, a different fastener such as the fastener 170 can be used to secure each clip bracket 500*a,b* to the respect uprights 110,120, and the clearance holes 580 can be sized, shaped, and spaced differently than shown. For example and without limitation, instead of a single clearance hole 580, a pair of clearance holes 580 can be positioned directly adjacent each other and each pair of clearance holes 580 can be spaced apart by the same distance by which the vertical positions 1000 are spaced apart.

As shown in FIG. 3, the method can further comprise inserting one of the end subpanels 210,220,310 of the display panel 200,300 horizontally into the main entrance 552 (shown in FIGS. 4A and 4B) of the insertion slot 550 of the first clip bracket 500*a* and into the main entrance 552 of the insertion slot 550 of the second clip bracket 500*b*. The method can further comprise securing or holding the respective first end subpanel 210,310 of the display panel 200,300 inside the insertion slot 550 of the first clip bracket 500*a* and the second end subpanel 210 of the display panel 200 (or the corresponding second end subpanel of the display panel 300) in the insertion slot 550 of the second clip bracket 500*b*.

Securing or holding the display panel 200,300 can comprise applying pressure to the display panel 200,300 with the engagement ribs 530*a,b,c* of the clip portions 520 and the base portions 510 of clip brackets 500*a,b*. The method can further comprise bending the first end subpanel 210,310 and the second end subpanel 220 of the display panel 200,300 with respect to the center subpanel 250,350 of the display panel 200,300 before inserting the display panel 200,300 into the first clip bracket 500*a* and the second clip bracket 500*b*.

In some aspects, more than a single quantity of the clip bracket 500*a,b* can be used to secure each end 205,206 of the display panel 200 (or corresponding ends of the display panel 300). For example and without limitation, a pair of the clip brackets 500*a* can be used to secure the first end subpanel 210, and a pair of the clip brackets 500*b* can be used to secure the second end subpanel 220. On each end 205,206, one of the pair of the clip brackets 500*a,b* can be positioned proximate to a top end of the display panel 200, and another of the pair of the clip brackets 500*a,b* can be positioned proximate to a bottom end of the display panel 200. The location of each of the clip brackets 500*a,b* can vary. More specifically, for example and without limitation, each of the clip brackets 500*a,b* can be placed at any height on the uprights 110,120.

Figure 11:
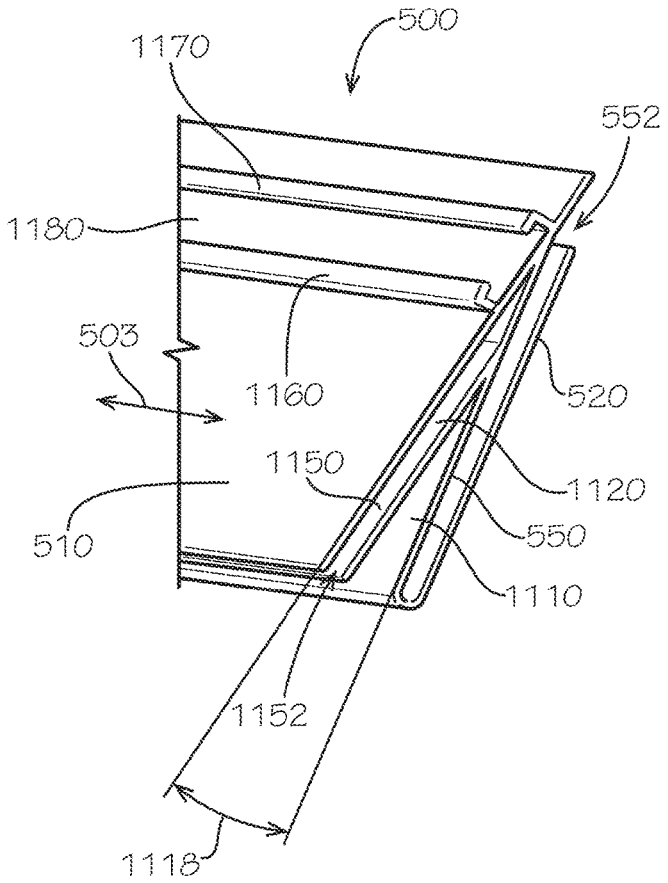
FIG. 11 is a partial perspective view of the clip bracket of the store display of FIG. 2 in accordance with another aspect of the current disclosure.

FIG. 11 shows another aspect of a clip bracket 500. As shown in FIG. 11, the clip bracket 500 can define a mounting slot 1180 in the base portion 510. The mounting slot 1180, which can be defined by a first slot rail 1160 and a second slot rail 1170, can be sized to receive and capture the head 810 of the clip fastener 800 when the mounting slot 1180 is made to slide over the head 810 of the clip fastener in the longitudinal direction 503 of the clip bracket 500. In some aspects, the clip bracket 500 can comprise a web portion 1110, which can extend between the base portion 510 and the clip portion 520. In other aspects, the clip bracket 500 can comprise a rear clip portion 1120 defining an insertion slot 1150, which can define a rear entrance 1152. As shown, the clip portion 520 and the web portion 1110 can define the insertion slot 550 and the main entrance 552. In some aspects, the web portion 1110 can be angled with respect to the base portion by a bend angle 1118. As shown, the clip bracket 500 can receive a portion of the display panel 200,300 from the front or from the rear when the clip bracket 500 is installed as in FIG. 12.

Figure 12:
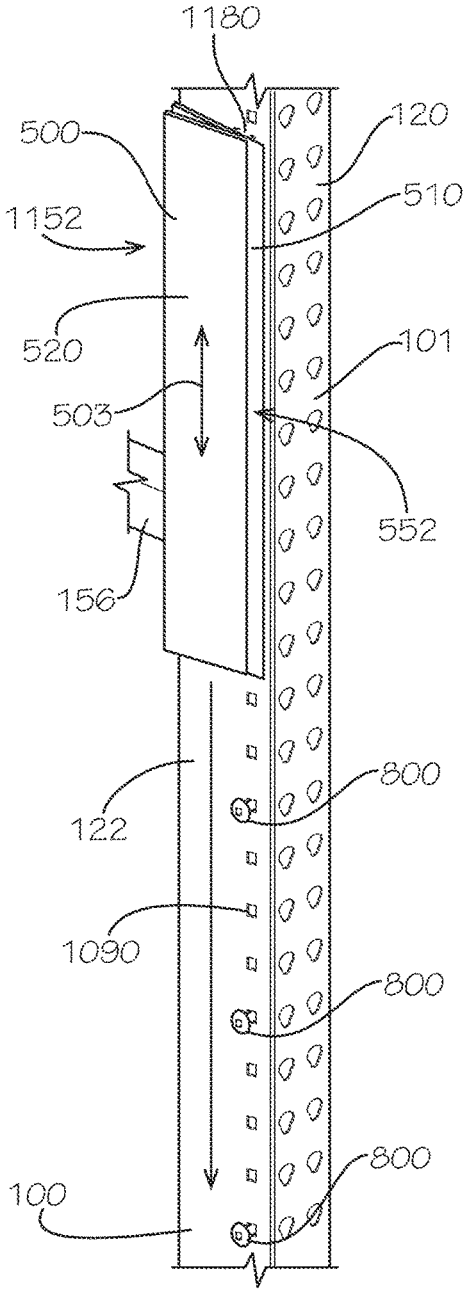
FIG. 12 is a perspective view of a portion of one side of the store display of FIG. 2 during assembly of the clip bracket of FIG. 11 and the clip fastener of FIG. 8 to the frame of the store display.

As shown in FIG. 12, a method of assembling the display system 50 can comprise installing a plurality of clip fasteners 800 into holes 1090 in a structure such as, for example and without limitation, the upright 120 of the frame 100. The method can further comprise placing the clip bracket 500 against the inward facing surfaces 112,122 and aligning the clip bracket 500 above—or below—the plurality of clip fasteners 800 such that the mounting slot 1180 can slide over the head 810 of each of the plurality of clip fasteners 800 in the longitudinal direction 503 of the clip bracket 500. The method can further comprise inserting the display panel 200,300 into the insertion slot 550 via the main entrance 552 or into the insertion slot 1150 via the rear entrance 1152.

In some aspects, as shown, the clip brackets 500 need not be removed to replace the display panel 200,300, which is common in a retail environment products and seasons change. In addition, the clip brackets 500 facilitate repeated installation and removal of display panels 200,300 and yet hide the clip brackets 500 used to secure them. Especially in installations where access to behind the uprights 110,120, 130,140 or inside the frame 100 is not practical, the flared or widened slot entrance height 710 of the clip bracket 500 can facilitate "blind" installation of the end subpanels 210,310, 220 of the display panel 200,300.

One should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily comprise logic for deciding, with or without user input or prompting, whether these features, elements and/or steps are included or are to be performed in any particular aspect.

It should be emphasized that the above-described aspects are merely possible examples of implementations, merely set forth for a clear understanding of the principles of the present disclosure. Any process descriptions or blocks in flow diagrams should be understood as representing modules, segments, or portions of code which comprise one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described aspect(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A display system comprising:

a first upright;

a second upright offset horizontally from the first upright by a frame separation distance, the first upright and the second upright defining a display opening therebetween;

a first clip bracket secured to the first upright with a first clip fastener comprising a head and a shank, the shank extending through a first hole defined in the first clip bracket and the first upright; and a second clip bracket secured to the second upright with a second clip fastener comprising a head and a shank, the shank extending through a second hole defined in the second clip bracket and the second upright, each of the first clip bracket and the second clip bracket comprising a base portion and a clip portion, the base portion and the clip portion defining an insertion slot, the clip portion of each of the first clip bracket and the second clip bracket configured to hold a display panel inside the corresponding insertion slot.

2. The system of claim 1, further comprising the display panel, a first end of the display panel secured inside the insertion slot of the first clip bracket and a second end of the display panel secured inside the insertion slot of the second clip bracket, the display panel extending across the display opening from the first clip bracket to the second clip bracket.

3. The system of claim 2, wherein the first clip bracket, the second clip bracket, and the display panel together cover a full display opening width of the display opening from the first clip bracket to the second clip bracket.

4. The system of claim 2, wherein the display panel comprises a first end subpanel proximate to the first end and a second end subpanel proximate to the second end, the first end subpanel extending into the insertion slot of the first clip bracket and the second end subpanel extending into the insertion slot of the second clip bracket.

5. The system of claim 2, wherein the display panel comprises five subpanels, the five subpanels comprising a first end subpanel proximate to the first end, a second end subpanel proximate to the second end, a first intermediate subpanel connected to the first end subpanel, a second intermediate subpanel connected to the second end subpanel, and a center subpanel connected to each of the first intermediate subpanel and the second intermediate subpanel.

6. The system of claim 5, wherein each of the first upright and the second upright define a front surface of the frame, at least a portion of an outside surface of the center subpanel of the display panel offset behind the front surface of the frame.

7. The system of claim 1, wherein each of the first upright and the second upright comprises an inward-facing surface, the first clip bracket secured to the inward-facing surface of the first upright and the second clip bracket secured to the inward-facing surface of the second upright.

8. The system of claim 1, wherein each of the first clip fastener and the second clip fastener comprises a push-in fastener.

9. The display system of claim 1, wherein each of the base portion and the clip portion of each of the first clip bracket and the second clip bracket comprises an engagement rib extending along a longitudinal direction of the clip bracket, a position of the engagement rib of the clip portion offset in a transverse direction of the corresponding clip bracket from a position of the engagement rib of the base portion.

10. The display system of claim 1, further defining a plurality of clearance holes aligned along a longitudinal direction of each of the first clip bracket and the second clip bracket.

11. The display system of claim 10, wherein each of the plurality of clearance holes is defined in the base portion of each corresponding clip bracket, a center of each of the plurality of clearance holes offset from a forward edge of the clip portion of the corresponding clip bracket.

12. The display system of claim 1, wherein the clip portion of each of the first clip bracket and the second clip bracket comprises an edge flange that is angled with respect to a main portion of the clip portion, the edge flange defining a forward edge of the clip portion, a slot entrance height of the insertion slot at the forward edge greater than a nominal width of the insertion slot.

13. The display system of claim 1, further defining a mounting slot in the base portion of each of the first clip bracket and the second clip bracket, the mounting slot sized to receive a head of a corresponding one of the first clip fastener and the second clip fastener.

14. A method of assembling a display system, the method comprising:

securing a first clip bracket to a first upright of the display system with a first clip fastener, the first clip bracket comprising a base portion and a clip portion, the base portion and the clip portion of the first clip bracket defining the insertion slot of the first clip bracket, the first clip fastener comprising a head and a shank, the shank of the first clip fastener extending through the first clip bracket and the first upright;

securing a second clip bracket to a second upright of the display system with a second clip fastener, the second clip bracket comprising a base portion and a clip portion, the base portion and the clip portion of the second clip bracket defining the insertion slot of the second clip bracket, the second clip fastener comprising a head and a shank, the shank of the second clip fastener extending through the second clip bracket and the second upright; and inserting a display panel horizontally into the insertion slot of the first clip bracket and the insertion slot of the second clip bracket.

15. The method of claim 14, further comprising applying pressure to the display panel with an engagement rib of a one of the clip portion and the base portion of each of the first clip bracket and the second clip bracket, the engagement rib of each of the first clip bracket and the second clip bracket extending along a longitudinal direction of the clip bracket.

16. The method of claim 14, wherein the display panel comprises five subpanels, the five subpanels comprising a first end subpanel proximate to the first end, a second end subpanel proximate to the second end, a first intermediate subpanel connected to the first end subpanel, a second intermediate subpanel connected to the second end subpanel, and a center subpanel connected to each of the first intermediate subpanel and the second intermediate subpanel, the method further comprising bending the first end subpanel and the second end subpanel of the display panel with respect to the center subpanel of the display panel before inserting the display panel into the first clip bracket and the second clip bracket.

17. The method of claim 14, further comprising:

installing the first clip fastener through the base portion of the first clip bracket and into the first upright by pushing the first clip fastener into a hole in the first upright; and installing the second clip fastener through the base portion of the second clip bracket and into the second upright by pushing the second clip fastener into a hole in the second upright.

18. The method of claim 14, wherein each of the first clip fastener and the second clip fastener comprises a push-in fastener.

19. The display system of claim 1, wherein the head of each clip fastener is configured to lay flat against the base portion of a corresponding one of the first clip bracket and the second clip bracket.

20. The display system of claim 1, wherein the shank of each clip fastener comprises a plurality of locking ribs, the plurality of locking ribs configured to secure the clip fastener inside one of a portion of the first hole defined in the first upright and a portion of the second hole defined in the second upright.

* * * * *